US010576610B2

(12) United States Patent
Valentini

(10) Patent No.: US 10,576,610 B2
(45) Date of Patent: Mar. 3, 2020

(54) BACKING PAD FOR A HAND GUIDED POLISHING OR SANDING TOOL AND HAND GUIDED POLISHING OR SANDING TOOL WITH SUCH A BACKING PAD

(71) Applicant: Guido Valentini, Milan (IT)

(72) Inventor: Guido Valentini, Milan (IT)

( * ) Notice: Subject to any disclaimer, the term of this patent is extended or adjusted under 35 U.S.C. 154(b) by 569 days.

(21) Appl. No.: 14/956,933

(22) Filed: Dec. 2, 2015

(65) Prior Publication Data

US 2016/0158920 A1 Jun. 9, 2016

(30) Foreign Application Priority Data

Dec. 5, 2014 (EP) ..... 14196627

(51) Int. Cl.
*B24D 9/08* (2006.01)
*B24B 55/10* (2006.01)

(52) U.S. Cl.
CPC ..... *B24D 9/08* (2013.01); *B24B 55/102* (2013.01)

(58) Field of Classification Search
CPC . B24D 9/08; B24D 9/085; B24D 7/10; B24D 7/12; B24B 55/102; B24B 55/10; B24B 23/02
USPC ..... 451/359, 456, 490, 449, 488
See application file for complete search history.

(56) References Cited

U.S. PATENT DOCUMENTS 4,058,926 A * 11/1977 Harrigan ..... A01K 95/00 43/43.12
4,145,848 A * 3/1979 Hutchins ..... B24B 55/102 451/359
4,287,685 A * 9/1981 Marton ..... B24D 9/08 451/359
7,094,138 B2 * 8/2006 Chang ..... B24B 55/10 451/359

(Continued)

FOREIGN PATENT DOCUMENTS

DE 4124520 A1 1/1993
EP 0285042 A1 10/1988

(Continued)

OTHER PUBLICATIONS

Communication dated May 21, 2015 enclosing the Extended European Search Report dated May 11, 2015 for European Patent Application No. 14196627.5.

*Primary Examiner* — George B Nguyen
(74) *Attorney, Agent, or Firm* — Howard & Howard Attorneys PLLC

(57) ABSTRACT

A backing pad for a power tool having plate-like form and a trapezoid cross-section with a top surface, a larger bottom surface and a slanting circumferential surface connecting the top and bottom surfaces. The backing pad can be connected to a tool shaft of the tool and is adapted for receiving a polishing or sanding material on the bottom surface. The backing pad is provided with a recess and a plurality of holes and channels that creates a predefined air flow between the bottom surface of the backing pad and a working surface. At (Continued)

least one hole ending in an opening is located in an annular outer section of the bottom surface, the annular outer section being located opposite to the slanting circumferential surface of the backing pad. The additional hole is in connection with at least one opening located in the top surface of the backing pad.

15 Claims, 7 Drawing Sheets

(56) References Cited

U.S. PATENT DOCUMENTS

| | | | | |
|---|---|---|---|---|
| 7,473,165 | B1 * | 1/2009 | Berryhill | B24B 55/10 451/354 |
| 8,636,562 | B2 * | 1/2014 | Marton | B24B 45/003 451/359 |
| 2005/0058518 | A1 * | 3/2005 | Valentini | B24B 23/02 409/134 |
| 2010/0015900 | A1 * | 1/2010 | Valentini | B24B 55/102 451/490 |

FOREIGN PATENT DOCUMENTS

| | | | |
|---|---|---|---|
| EP | 1514644 | A1 | 3/2005 |
| EP | 2145733 | A1 | 1/2010 |
| EP | 2551056 | A1 | 1/2013 |
| WO | 2014131936 | A1 | 9/2014 |

* cited by examiner

BACKING PAD FOR A HAND GUIDED POLISHING OR SANDING TOOL AND HAND GUIDED POLISHING OR SANDING TOOL WITH SUCH A BACKING PAD

CROSS-REFERENCE TO RELATED APPLICATIONS

The present application claims priority to and all the benefits of European Patent Application No. 14 196 627.5-1702, filed Dec. 5, 2014 which is hereby expressly incorporated herein by reference in its entirety.

BACKGROUND OF THE INVENTION

1. Field of the Invention

The present invention is directed to a backing pad for a hand guided polishing or sanding tool, as well as hand guided polishing or sanding tools including the backing pad of the present invention.

2. Description of the Related Art

Backing pads are used for a hand guided polishing or sanding tool. The tool can be electrically or pneumatically actuated. The backing pads known in the related art have an essentially plate-like form and a trapezoid cross-section with a top surface, a bottom surface and a slanting circumferential surface resulting in the bottom surface being larger than the top surface. The backing pads are adapted to be fixedly connected to a moving mounting part of the tool at its top surface and to receive a polishing or sanding material on the bottom surface. The backing pads are often provided with a plurality of channels each extending essentially radially and essentially parallel to the top and bottom surfaces through at least part of the backing pad. The backing pad has a central recess located in the bottom surface and a plurality of holes having a longitudinal extension essentially perpendicular to the top and bottom surfaces through the backing pad and connecting an opening in the bottom surface with an opening in the top surface.

Further, electrically or pneumatically actuated hand guided polishing or sanding tools include a backing pad with a polishing or sanding material attached to a bottom surface of the backing pad. The polishing or sanding material attached to the bottom surface performs a rotary, an orbital, a roto-orbital or a random orbital actuating movement if the tool is actuated.

Backing pads of the above-mentioned kind are well-known in the prior art. The backing pads usually have a plate-like circular form and are fixedly connected with their top surface to a moving mounting part of the tool performing the actuating movement. The tool can be actuated electrically or pneumatically. The tool's mounting part and consequently also the backing pad connected thereto performs a rotary, an orbital, a roto-orbital or a random orbital actuating movement around an axis of rotation if the tool is turned on. The tool's mounting part is usually a tool shaft actuated by a motor (electric or pneumatic) of the tool directly or via a respective gear mechanism located between the motor shaft and the tool shaft. The tool's mounting part includes an attachment (e.g. a threaded bore or an engagement element) for connecting the backing pad thereto. A threaded bore can be connected to a corresponding threaded rod provided at the top surface of the backing pad. An engagement element can be inserted into a corresponding receiving opening provided at the top surface of the backing pad and fixedly connected thereto.

Backing pads of the above-identified kind are known, for example, from EP 2 551 056 A1. The known backing pads comprise a carrier layer made of a rigid material and forming the top surface of the backing pad. The rigid material can be a rigid plastic material (e.g. nylon) or metal or a combination of these or other rigid materials. Furthermore, the backing pad is provided with an adhesive layer forming the bottom surface of the backing pad and adapted for releasably connecting the polishing or sanding material to the bottom surface of the pad. The polishing material can comprise, for instance, foamed plastic material, fur, micro fibers or the like. The sanding or abrasive material can be a sanding paper, a sanding fabric or the like. The adhesive layer can comprise, for instance, part of a hook-and-loop-connection (Velcro®) or similar. Finally, the backing pad comprises an interface layer made of a resilient and/or flexible material (e.g. polyurethane foam) and located between the carrier layer and the adhesive layer. Usually the backing pad is manufactured by prefabricating each of the layers separately and attaching them to one another by a gluing process.

The tool can be provided with a dust aspiration system creating an air flow during operation of the motor directed away from the working surface towards a suction tube. The air flow is directed from the working surface through holes (or bores) and channels (or cavities) provided in the backing pad towards the suction tube thereby aspiring dust laden air and providing it to a dust collecting unit, for example in the form of a dust filter or a separate dust suction device (e.g. vacuum cleaner) connected to the tool's suction tube. While the channels usually extend essentially radially in respect to the axis of rotation of the backing pad (or slightly inclined in respect to the radial direction), the bores usually extend axially, that is parallel to the axis of rotation, or slightly inclined in respect to the axial direction. The aspiration system can comprise a shroud (or cap) covering the top surface of the backing pad or at least part of it, thereby providing for an efficient dust aspiration. The polishing or sanding material attached to the bottom surface of the backing pad can be provided with holes corresponding in size and/or position to the backing pad's holes in the bottom surface and/or can be perforated in order to allow aspiration of the dust laden air from the working surface through the polishing or sanding material.

Another example for a known backing pad is offered for sale by KWH Mirka Ltd. It has 150 mm diameter and is adapted for an orbital, roto-orbital or random orbital actuating movement of 5 mm. The known backing pad features a central recess as air inlet for air flow and for extracting dust away from the center of the backing pad by the tool's dust extraction system. This backing pad is adapted to work with Mirka's so-called "Net Sanding" dust extraction concept, which comprises a sanding material having a net-like support structure and a backing pad with a plurality of essentially radially extending channels and essentially axially extending bores for aspiring dust laden air from the working surface through the net-like structure. The sanding material consists of dense network of polyamide fabric threads forming the net-like structure onto which the abrasive grit is bonded. This open weave net structure allows the dust particles to pass through the sanding material into the bores and channels of the backing pad and further into the tool's suction tube. This is described in detail in WO 2014/131936 A1.

The holes provided in the known backing pads extend through the bottom layer and at least through part of the resilient interface layer. Although some of the holes may even extend through the rigid carrier layer and open into openings in the top surface, the holes do not necessarily all extend through the entire height of the backing pad. Two or more holes, whether extending through the entire height of the backing pad or not, may be interconnected by one or more conduits. The conduits provided in the backing pads can extend through the resilient interface layer or the rigid carrier layer. Some of the conduits may extend along the top surface of the backing pad, which is then covered by a deflection plate for hermetically closing or sealing off the conduits.

In the backing pad known from Mirka there are radially extending horizontal channels each interconnecting an opening located in the slanting circumferential surface of the backing pad with a central recess. These interconnecting channels do not cross or intersect at any point the holes extending essentially axially through at least part of the backing pad. The interconnecting channels provide for a direct connection of the air surrounding the circumferential outer surface of the backing pad with the central recess. This constellation leads to a certain air flow during operation and use of the tool. The air flow runs from the environment surrounding the slanting circumferential surface of the backing pad, through the radially extending channels into the center recess. The air is blown out of the recess and is drawn radially outwards between the bottom surface of the backing pad and the working surface of the workpiece to the openings of the various holes distributed on the bottom surface of the backing pad thereby gathering dust. The dust laden air enters the openings in the bottom surface, passes through the holes and conduits (not the channels interconnecting the openings in the circumferential surface with the central recess) and exits the holes through openings located in the top surface. The various dust laden air streams exiting the openings in the top surface are combined by the shroud or cap of the dust extraction system and conveyed to the suction tube and further to the dust collecting unit, like a dust filter or a separate dust suction device (vacuum cleaner) connected to the tool's suction tube. In this known backing pad the center recess serves for providing enough air to the working surface at the center of the backing pad for realizing the desired radially extending air flow on the working surface from the central recess to the openings of the various holes in the bottom surface of the backing pad.

One disadvantage of the known backing pad is the fact that there are no holes near the outer circumference of the bottom surface and therefore, the dust extraction effect on the working surface is rather weak at the outer circumference of the backing pad and not very effective. In particular, due to the centrifugal force of the rotating backing pad, the dust generated at the outer circumference of the bottom surface is blown into the environment and leads to a severe increase of the dust concentration in the environmental air. In the known backing pad the holes and channels are formed after manufacturing of the pad by a subsequent drilling process. Due to the material used for the known backing pad in the prior art, in particular for the interface layer made of a resilient and flexible plastic material, it is not possible to form the holes and channels during its manufacturing. Therefore, in the prior art drilling additional holes extending essentially axially through the backing pad at the outer circumference of the bottom surface of the backing pad would make these additional holes exit on the top through the slanting circumferential surface. However, the slanting circumferential surface is not covered by the shroud or cap of the dust extraction system. Hence, these additional holes would be useless in the sense that they could not be used for aspiring dust. Furthermore, with the known backing pads having an air flow along the working surface from the center recess to the external circumference of the bottom surface, most of the dust laden air will already have been aspired by the holes located on the way from the center recess to the external circumference of the bottom surface. The air flow arriving at the external circumference of the bottom surface is very weak. So in the known backing pads even if there were additional holes located near the external circumference of the bottom surface they would not have much effect in terms of reducing the contamination of the surrounding air with dust and other small particles.

SUMMARY OF THE INVENTION

Thus, one object of the present invention is to increase efficiency of the dust extraction process during use of a power tool having a rotating working element in order to reduce the contamination of the environmental air with dust and other small particles.

More specifically, the present invention overcomes the disadvantages in the related art in a backing pad for a hand guided polishing or sanding tool wherein the backing pad has an essentially plate-like form and a trapezoid cross-section with a top surface, a bottom surface and a slanting circumferential surface resulting in the bottom surface that is larger than the top surface. The backing paid is adapted to be fixedly connected to a moving mounting part of the tool at its top surface and to receive a polishing or sanding material on the bottom surface. The backing pad is provided with a plurality of channels, each extending essentially radially and essentially parallel to the top and bottom surfaces through at least part of the backing pad. A central recess is located at the bottom surface and a plurality of holes each having a longitudinal extension essentially perpendicular to the top and bottom surfaces extend through the backing pad and connecting an opening in the bottom surface with an opening in the top surface. The backing pad is provided with at least one additional hole each located such that it ends in an opening in an annular outer section of the bottom surface, the annular outer section located opposite to the slanting circumferential surface of the backing pad, and that the at least one additional hole ending in the opening in the annular outer section of the bottom surface of the backing pad is in connection with at least one opening located in the top surface of the backing pad.

One aspect of the present invention is to provide additional holes with their openings on one end being located at or near the external circumference of the bottom surface. This allows an aspiration of dust laden air even near the external circumference of the backing pad. The additional holes each lead to an opening located in the top surface. As the top surface or most of it is covered by the shroud or cap of the tool's dust extraction system, the dust laden air flow from the additional holes exiting the openings in the top surface can be efficiently conveyed to the dust collecting unit, for example a dust filter or a separate dust suction device (vacuum cleaner), attached to a suction tube of the tool. Hence, the present invention provides for a particularly efficient dust aspiration and, in particular, for a low degree of contamination of the environmental air surrounding the tool with dust and other particles during its use.

The backing pad according to the present invention can be easily produced due to the suggested molding process for manufacturing the backing pad and during which the holes and channels, including the additional holes located near the outer circumference of the backing pad, are provided in the backing pad. No separate drilling process for providing the holes and channels in the backing pad is necessary.

The backing pad may include a carrier layer made of a rigid material and forming the top surface of the backing pad, an adhesive layer forming the bottom surface of the backing pad and adapted for releasably connecting the polishing or sanding material thereto and an interface layer made of a resilient material and located between the carrier layer and the adhesive layer. The adhesive layer may comprise a hook-and-loop fastener surface or a glue-based adhesive surface for releasably attaching the polishing or sanding material to the bottom surface of the backing pad. In one embodiment, the carrier layer is made of a rigid plastic material, metal or a composite material comprising any of these rigid materials, including glass fiber or a glass fiber composite material. The carrier layer at the top of the backing pad may include a threaded rod or a receiving opening for fixedly connecting the backing pad to the moving mounting part of the tool (e.g. a tool shaft). The interface layer may be made of a resilient and flexible plastic material, in particular polyurethane foam.

It is possible that the at least one additional hole ending in the opening in the annular outer section of the bottom surface extends transversally towards the at least one opening located in the top surface of the backing pad. Ultimately, the backing pad according to the present invention could include an additional opening in the annular outer section of the bottom surface and an opening in the top surface in a region covered by a shroud or cap of the tool's dust extraction system, both openings being interconnected by a transversally extending additional hole.

However, in one embodiment, at least one additional hole ending in the opening in the annular outer section of the bottom surface of the backing pad may have a longitudinal extension essentially perpendicular to the top and bottom surfaces of the backing pad. Similarly, the at least one opening located in the top surface of the backing pad and in connection with the at least one additional hole opens into at least one further additional hole which may have a longitudinal extension essentially perpendicular to the top and bottom surfaces. Preferably, the at least one additional hole and the at least one further additional hole do not go through the entire height of the backing pad from the bottom surface to the top surface. Rather, it is suggested that the at least one additional hole ending in the opening in the annular outer section of the bottom surface of the backing pad and the at least one further additional hole ending in the at least one opening located in the top surface of the backing pad and in connection with the at least one additional hole are preferably interconnected with one another by at least one additional channel extending essentially parallel to its top and bottom surfaces.

The plurality of channels and—if present—the at least one additional channel each extend essentially radially or slightly inclined in respect to the radial direction through the backing pad or part of it. The channels and the at least one additional channel may have cross sections and diameters varying along their longitudinal extension. The channels and the at least one additional channel may even have the form of a chamber. Finally, it is even possible that in a longitudinal section extending parallel to the top and bottom surfaces of the backing pad, the channels are arcuated along their longitudinal extensions, providing for sickle-like channels radially extending in the backing pad. "Radially" in this connection means that one end of the channels faces towards the outer circumference of the backing pad and the other end faces towards the center of the backing pad.

In one embodiment, the backing pad is manufactured by molding all three layers and attaching them to one another by a single molding process. According to this embodiment, the different materials for producing the various layers of the backing pad are poured or injected into a molding tool. Sliders having an essentially peg-like form are introduced into the mold from various directions for creating cavities forming the holes and channels, including the additional holes near the outer circumference of the backing pad and—if present—additional channels. Then the molding tool is closed and the material is cured possibly by applying heat and/or pressure to the material in the mold.

In order to facilitate manufacturing of the backing pad and insertion of the additional channels during the molding process, the at least one additional channel interconnecting the at least one additional hole and the at least one further additional hole, may proceed radially outwards and opens into the slanting circumferential surface of the backing pad. Such an additional channel can be provided in the backing pad during its molding process by sliders having an essentially peg-like form. The sliders can be introduced into the mold radially from outside the slanting circumferential surface of the backing pad. The sliders can create cavities forming the additional channels interconnecting the at least one additional hole ending in the opening in the annular outer section of the bottom surface of the backing pad and the at least one further additional hole ending in the at least one opening in the top surface of the backing pad.

Furthermore, according to one embodiment of the invention at least one of the plurality of channels each extending essentially parallel to its top and bottom surfaces interconnects the central recess with at least one of the plurality of holes each having a longitudinal extension essentially perpendicular to the top and bottom surfaces and connecting an opening at the bottom surface with an opening in the top surface of the backing pad. In this case, none of the plurality of additional channels each extending essentially parallel to the top and bottom surfaces of the backing pad opens into the slanting circumferential surface of the backing pad. Hence, the channels merely provide for a connection between the central recess and the plurality of holes with the longitudinal extension essentially perpendicular to the top and bottom surfaces. As the channels are not connected to the environment via openings located at the slanting circumferential surface of the backing pad, there is no air flow of ambient air from the environment along the channels into the central recess. The resulting air flow of the backing pad according to the present invention is completely different form the air flow of the known backing pads.

The backing pad according to the present invention has no air-flow connection from external openings located in the slanting circumferential surface of the backing pad to the central recess of the backing pad. Hence, during operation of the tool there is no air stream conveying air into the central recess. Rather, the central recess is used to aspirate dust laden air, too, thereby increasing the aspiration rate in the center of the backing pad. The air flow along the working surface runs radially inwards from the external circumference of the backing pad towards the central recess. This increases the efficiency of the aspiration of dust laden air because—in contrast to the known backing pad, where air flow to the center recess is restricted by the number and diameter of the radially extending channels—air can flow more freely along the working surface from the outer circumference towards the center of the backing pad.

The holes and their corresponding openings, respectively, in the top and bottom surfaces, which are interconnected with the central recess by the channels, are preferably located radially inside the annular outer section of the bottom surface, in particular directly opposite the top surface of the backing pad. Preferably, these channels are realized separately from and have no connection to the additional holes and—if present—additional channels opening into the outer circumferential surface of the bottom surface.

According to yet another embodiment of the invention the backing pad may include a deflection disk located above and spaced apart from the top surface, wherein the deflection disk has an essentially annular form and delimits an internal chamber between the top surface of the backing pad and the bottom side of the deflection disk, the internal chamber being closed radially outwards and being open radially inwards. The deflection disk provides for an effective functioning of the dust extraction system even with the backing plate performing large orbital actuating movements, for example larger than 12 mm. The size of an inner central opening of the annular deflection disk is designed such that a static shroud or cap of the tool's dust extraction system always covers the inner central opening during the orbital actuating movement of the backing pad thereby providing for an efficient dust aspiration. For even larger orbital actuating movements of the backing pad, for example 15 mm or 21 mm, the inner central opening can be provided even smaller, in order to assure that despite the large orbit of the backing pad's movement the shroud or cap of the dust extraction system always sufficiently covers the inner central opening. An air stream of dust laden air exiting an opening or an additional opening located in the top surface near the external circumference of the backing pad is led radially inwards within the internal chamber formed by the deflection disk until the stream of dust laden air reaches the inner central opening of the annular deflection disk, from where it is aspired by the shroud or cap and the rest of the dust extraction system.

The internal chamber may also be provided with radially extending airfoils circumferentially spaced apart from one another and adapted for enhancing a suction effect on the top surface of the backing pad for aspiring dust laden air from a working surface through the plurality of holes, additional holes, channels and—if present—additional channels provided in the backing pad. The airfoils are designed and located in the internal chamber so that they accelerate the airstream of dust laden air exiting the openings in the top surface and also exiting the additional openings in the top surface located near the external circumference of the backing pad. This increases effectiveness of the dust extraction system even more, in particular in the annular external section of the bottom surface of the backing pad.

The deflection disk may be made of a rigid material, in particular a rigid plastic material, glass fiber or a glass fiber composite material. The deflection disk can be an integral part of the backing pad, in particular of the carrier layer. However, it is preferred that the deflection disk is manufactured separately from the rest of the backing pad, in particular form the carrier layer. The separate deflection disk can be fixed to the backing pad or the carrier layer, respectively, by a snap-in connection, a glue-connection, a laser-jointing process or in any other suitable manner.

The object of the present invention is also achieved by an electrically or pneumatically actuated hand guided polishing or sanding tool including a backing pad according to the present invention.

BRIEF DESCRIPTION OF THE DRAWINGS

Other advantages of the invention will be readily appreciated as the same becomes better understood by reference to the following detailed description when considered in connection with the accompanying drawings, wherein.

DETAILED DESCRIPTION OF THE INVENTION

Figure 1:
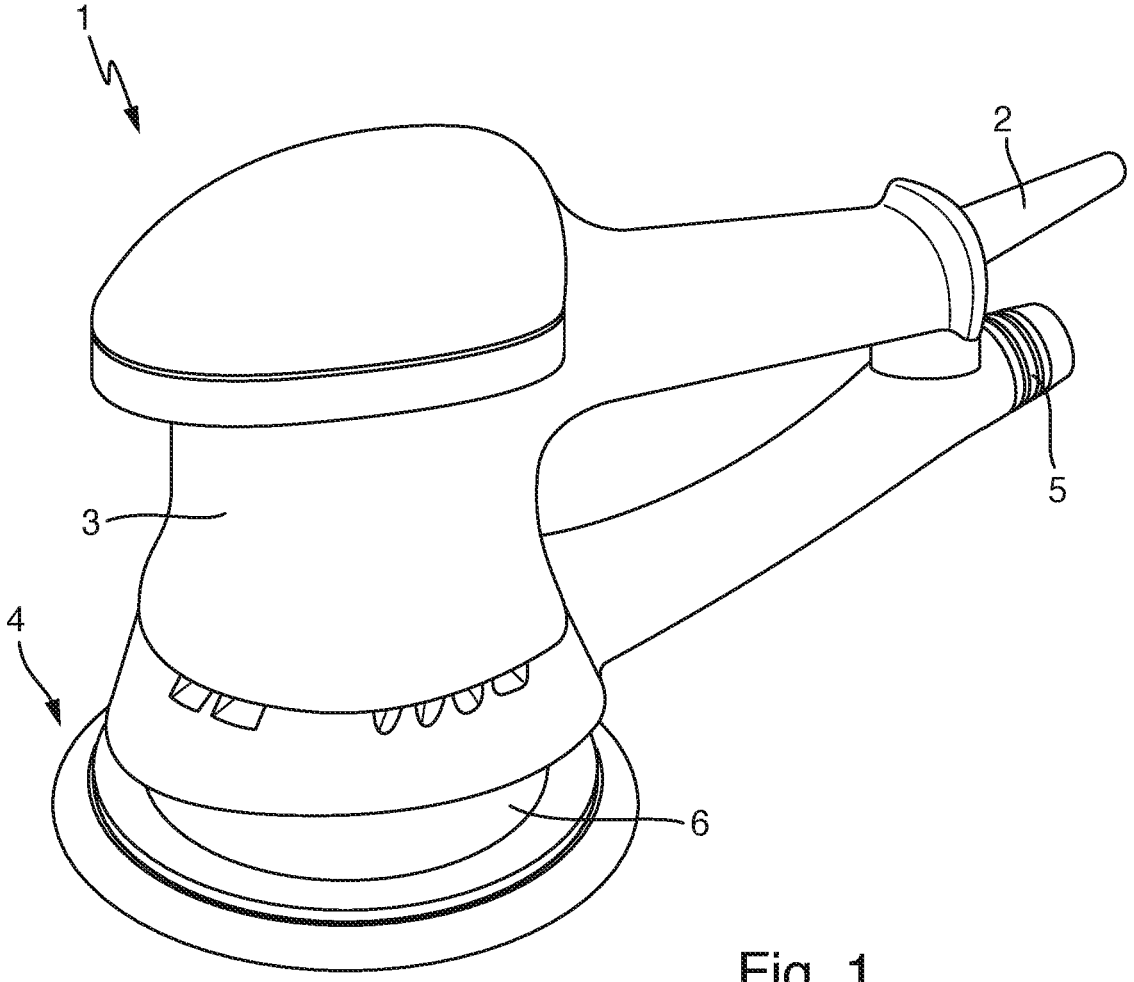
FIG. 1 is a perspective view of a hand-guided polishing or sanding power tool according to the present invention.

The present invention refers to a hand-guided power tool for polishing or sanding a working surface of a workpiece. An example of such a tool is shown in FIG. 1 and designated in its entirety with reference sign 1. The tool 1 can be actuated electrically or pneumatically. The tool 1 shown in FIG. 1 is actuated electrically through an electric cable 2, which is connected to a mains power supply. Alternatively, the electric tool 1 could also be operated by electricity from a rechargeable battery (not shown), preferably forming integral part of the tool 1. If the tool 1 was a pneumatic tool it would be connected to a compressed air supply for actuating a pneumatic motor of the tool.

In the case of the electric tool 1 shown in FIG. 1 an electric motor (not shown) is located inside a tool's housing 3. A rotating movement of a motor shaft of the electric motor of the tool 1 is transmitted into a desired actuating movement of a tool shaft of the tool 1 by a respective transmission gear (not shown). The actuating movement can be a rotary, an orbital, a roto-orbital or a random orbital movement. A backing pad 4 is connected to the tool shaft. The connection between the backing pad 4 and the tool shaft can be such that the backing pad 4 is freely rotatable in respect to the tool shaft. Alternatively, the connection could be provided in a torque proof manner such that a torque can be transmitted from the tool shaft to the backing pad 4. Hence, the backing pad 4 connected to the tool shaft preferably performs a rotary, an orbital, a roto-orbital or a random orbital actuating movement if the tool 1 is turned on.

The tool 1 is also provided with a self-generated dust extraction system. The dust extraction system comprises a fan (not shown) inside the housing 3 which is actuated when the tool 1 is turned on. In particular, the fan is actuated contemporaneously with the tool's electric motor. The fan creates an air flow of dust laden air directed from a bottom surface of the backing pad 4 to a suction tube 5. A dust collecting unit (not shown), like a dust filter or a separate dust suction device (e.g. a vacuum cleaner), can be connected to the suction tube 5 for collecting dust.

The backing pad 4 may have an essentially plate-like form and a trapezoid cross-section. The pad 4 has a top surface 4*a*, a bottom surface 4*b* and a slanting circumferential surface 17 resulting in the bottom surface 4*b* being larger than the top surface 4*a*.

Figure 11:
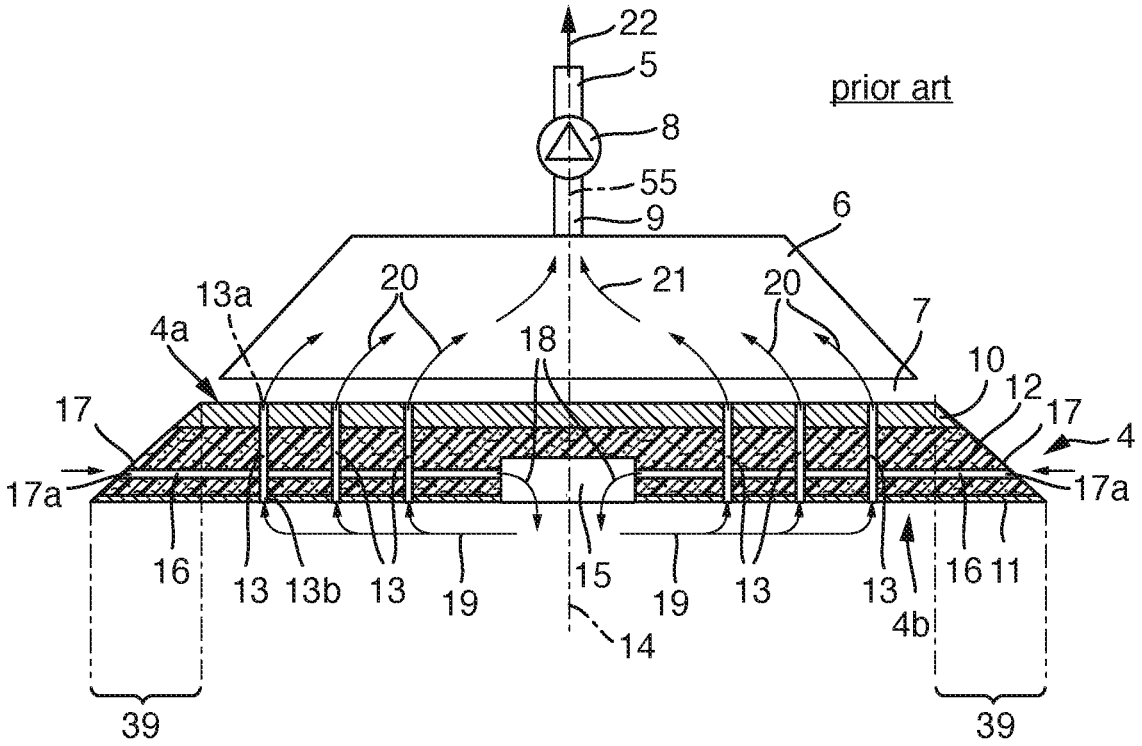
FIG. 11 is a perspective view of a conventional backing pad known from the prior art.

An example for a conventional backing pad 4 known from the prior art is shown in FIG. 11. This figure also shows a shroud or cap 6 of the dust extraction system of the tool 1. The cap 6 is fixed to the housing 3 and located above or on top of a top surface 4*a* of the backing pad 4. The cap 6 is pneumatically connected to the fan 8 of the dust extraction system by a pneumatic conduit 9. Dust-laden air is aspired through the cap 6 drawn through pneumatic conduit 9 and finally exhausted through the suction tube 5. The backing pad 4 performs the actuating movement relative to the static cap 6. A gap 7 is provided between the lower part of the cap 6 and the top surface 4*a* of the backing pad 4. The gap 7 could be surrounded by a shroud (not shown) made of flexible material fixed to the lower part of the cap 6 and in connection with (but not fixed to) the top surface 4*a* of the backing pad 4. The shroud can reduce vibrations during operation of the tool 1 and can further prevent dust from escaping to the environment through the gap 7.

Figure 2:
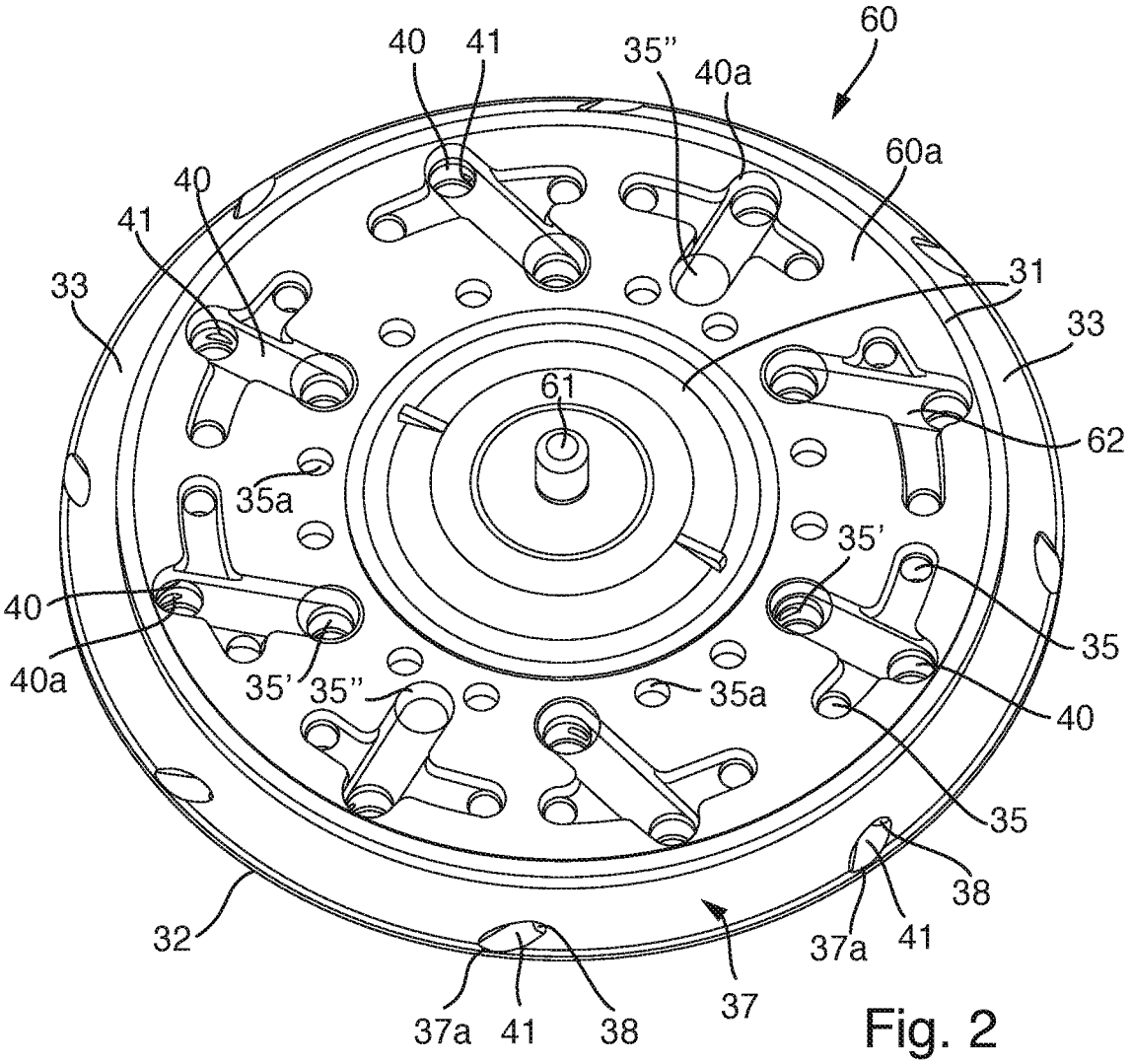
FIG. 2 is a perspective view of a backing pad for a hand-guided polishing or sanding power tool according to the present invention without a deflection disk.
Figure 4:
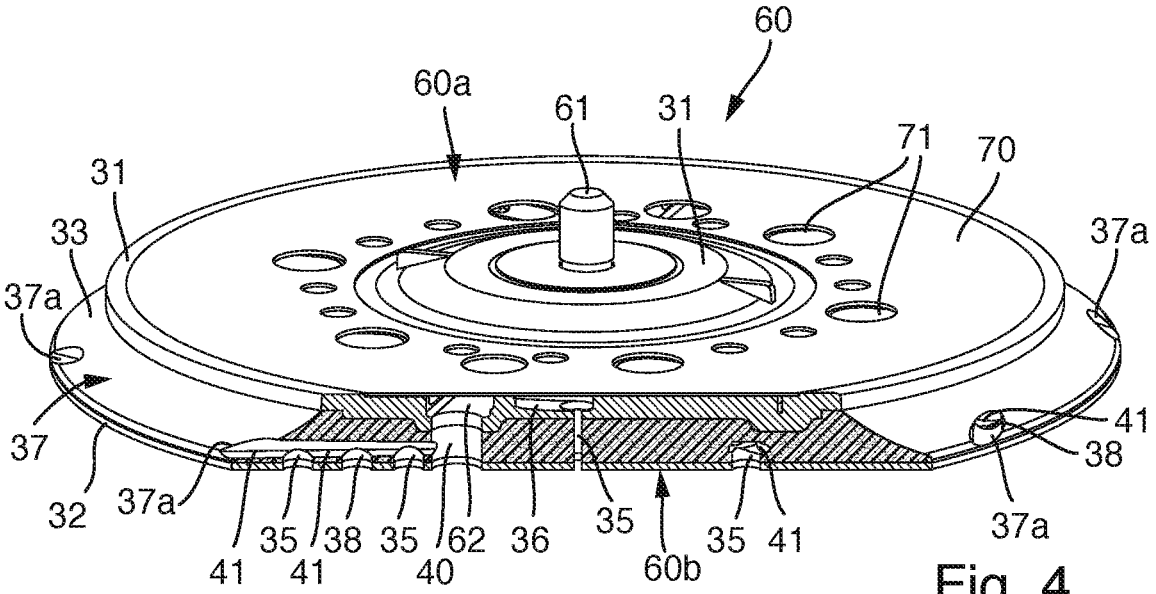
FIG. 4 is a partially sectional side perspective view of the backing pad illustrated in FIG. 2 with a deflection disk.

The known backing pad 4 comprises a carrier layer 10 made of a rigid material like plastic (e.g. nylon), a composite material (e.g. carbon fiber or glass fiber enforced plastic) or metal or a combination of these or other rigid materials. The carrier layer 10 forms at least part of the top surface 4*a* of the backing pad 4. On the top surface 4*a* of the backing pad 4, the carrier layer 10 can comprise a threaded rod or a receiving opening (both not shown in FIG. 11) for fixedly connecting the backing pad 4 to the distal end of the tool shaft. A threaded rod 61 is shown in FIGS. 2 and 4.

Furthermore, the backing pad 4 comprises an adhesive layer 11 forming a bottom surface 4*b* of the backing pad 4 and adapted for releasably connecting a polishing or sanding material thereto. The adhesive layer can comprise a hook-and-loop fastener (e.g. Velcro®) or a glue-based adhesive for releasably attaching the polishing or sanding material to the bottom surface 4*b*. The polishing or sanding material can comprise a support structure made of a fabric or a paper or plastic sheet, into which abrasive elements (e.g. made of metal, in particular aluminum oxide (corundum), minerals, silica or quartz crystals) or polishing elements (e.g. felt, fur, microfiber, foamed plastic material) are embedded. Together with the polishing or sanding material the backing pad 4 forms a rotating working element of the tool 1.

Finally, the backing pad 4 comprises an interface layer 12 made of a resilient and/or flexible material and located between the carrier layer 10 and the adhesive layer 11. The interface layer 12 is preferably made of a resilient and flexible material like polyurethane foam.

The backing pad 4 has an axis 14 of rotation or rotational symmetry. If the backing pad 4 performs a rotational actuating movement the axis 14 is an axis of rotation. The backing pad 4 has a plurality of holes 13 extending essentially axially in respect to the axis 14. The holes 13 can extend through one or more of the layers 10, 11, 12 or through part of one or more of these layers. The holes 13 have a first opening in the top surface 4*a* of the backing pad and a second opening 13*b* in the bottom surface 4*b* of the backing pad 4. The holes 13 provide for a connection of the top openings 13*a* with the bottom openings 13*b* either directly or indirectly through conduits (not shown) interconnecting one or more of the holes 13 with one another and extending (essentially horizontally) within the backing pad 4. "Axially" in the sense of the present invention means that the holes 13 interconnect top openings 13*a* and bottom openings 13*b*, which do not necessarily have to be located opposite each other but which can also be displaced in respect to one another. Therefore, also slightly inclined holes 13 are considered to extend essentially axially in the sense of the present invention.

A central recess 15 is provided in the bottom surface 4*b* of the backing pad 4. The recess 15 extends through the adhesive layer 11 and part of the interface layer 12. The backing pad 4 further comprises horizontal channels 16 extending essentially radially, which interconnect an opening 17*a* located in a slanting circumferential surface 17 of the backing pad 4 with the central recess 15. These interconnecting channels 16 do not cross or intersect at any point the holes 13 extending essentially axially through at least part of the backing pad 4. "Radially" in the sense of the present invention means that a first opening of the channels 16 (for example opening 17*a*) is located towards an external circumferential surface (e.g. surface 17) and that the opposite end of the channel 16 faces towards the center or the rotational axis 14 of the backing pad 4. The channels 16 may have cross sections and diameters varying along their longitudinal extension. The channels 16 may even have the form of a chamber. Further, it is possible that in a longitudinal section extending parallel to the top and bottom surfaces 4*a* and 4*b* of the backing pad 4, the channels 16 are arcuated along their longitudinal extensions, providing for sickle-like channels.

The interconnecting channels 16 provide for a direct connection of the air surrounding the circumferential outer surface 17 of the backing pad 4 with the central recess 15. This constellation leads to a certain air flow during operation and use of the tool 1. The air flow is indicated by arrows in FIG. 11. It runs from the environment surrounding the slanting circumferential surface 17 of the backing pad 4, through the openings 17*a* and the radially extending channels 16 into the center recess 15 (arrows 18). Then the air is blown out of the recess 15 and is drawn radially outwards between the bottom surface 4*b* of the backing pad 4 and a working surface of a work piece (not shown) to the openings 13*b* of the various holes 13 distributed along the bottom surface 4*b* of the backing pad 4, thereby gathering dust from the working surface (arrows 19). The dust-laden air enters the bottom openings 13*b*, passes through the holes 13 (and conduits if present) and exits the holes 13 through the top openings 13*a* (arrows 20). The various dust-laden air streams 20 exiting the openings 13*a* in the top surface 4*a* are combined by the cap 6 of the dust extraction system and (arrows 21) conveyed to the suction tube 5 and further to the dust collecting unit (arrows 22).

However, the known backing pads 4 suffer from the disadvantage that they do not comprise any holes 13 near the outer circumference of the bottom surface 4*b*. The respective annular outer section of the bottom surface 4*b* is indicated by reference sign 39. Therefore, the dust extraction effect on the working surface is rather weak or not present at all near annular outer section 39 of the backing pad 4. This effect is further deteriorated by the air flow 18 . . . 21 between the bottom surface 4*b* of the backing pad 4 and the working surface. The amount of air entering the central recess 15 through the radial channels 16 and available for conveying dust away from the working surface through the dust extraction system of the tool 1 is limited by the diameter and the overall number of the channels 16. On its way from the central recess 15 to the holes 13 located most externally (closest to the slanting circumferential surface 17) in the backing pad 4 most of the air is aspired through the holes 13 leaving almost no air left for conveying dust away from the working surface in the annular outer section 39 of the bottom surface 4*b*.

The backing pad according to the present invention solves these problems and, in particular, provides for an increased efficiency of the dust extraction process during use of the power tool 1 in order to reduce the contamination of the environmental air with dust and other small particles generated on a working surface during use of the tool 1.

Figure 9:
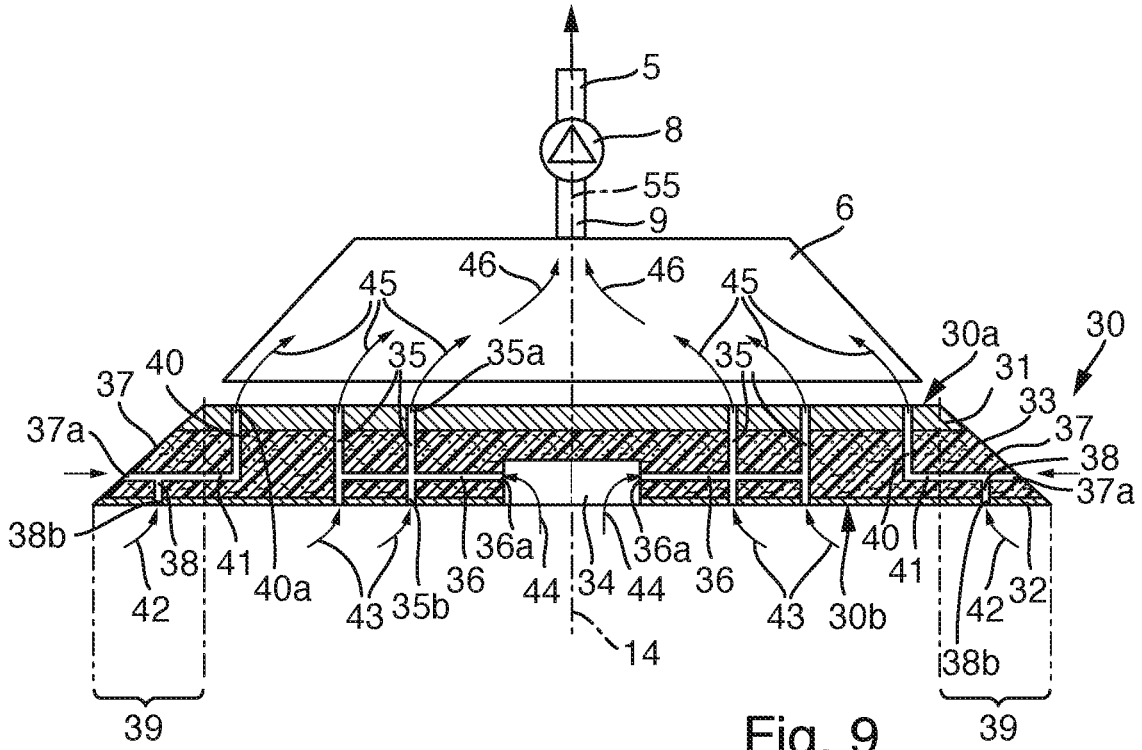
FIG. 9 is a schematic sectional view of an embodiment of a backing pad according to the present invention together with an aspiration cap of a dust extraction system of a tool, to which the backing pad is connected.

A first example of a backing pad according to the present invention is schematically shown in FIG. 9. The backing pad according to the present invention is designated with reference sign 30. The suction tube 5, the cap 6, the fan 8 and the pneumatic conduit 9 of the dust extraction system of the tool 1 remain unchanged. The backing pad 30 according to the present invention includes a carrier layer 31, an adhesive layer 32 and an interface layer 33. Furthermore, the backing pad 30 includes a central recess 34 located at a bottom surface 30*b* of the backing pad 30 and extending through the adhesive layer 32 and at least part of the interface layer 33. The backing pad 30 also includes holes 35 extending essentially axially in respect to the axis 14 of rotation. The holes 35 interconnect a top opening 35*a* in the top surface 30*a* of the backing pad 30 with bottom openings 35*b* in the bottom surface 30*b* of the backing pad 30. Furthermore, the backing pad 30 is provided with channels 36 extending essentially radially through the backing pad 30 and interconnecting some of the holes 35 with one another. At least part of the channels 36 continue towards the center of the backing pad 30, that is towards the axis 14, and open into the central recess 34. The lateral openings in the central recess 34 are designated with reference signs 36*a*. The channels 36 have no connection with an outer slanting circumferential surface 37 of the backing pad 30.

Figure 10:
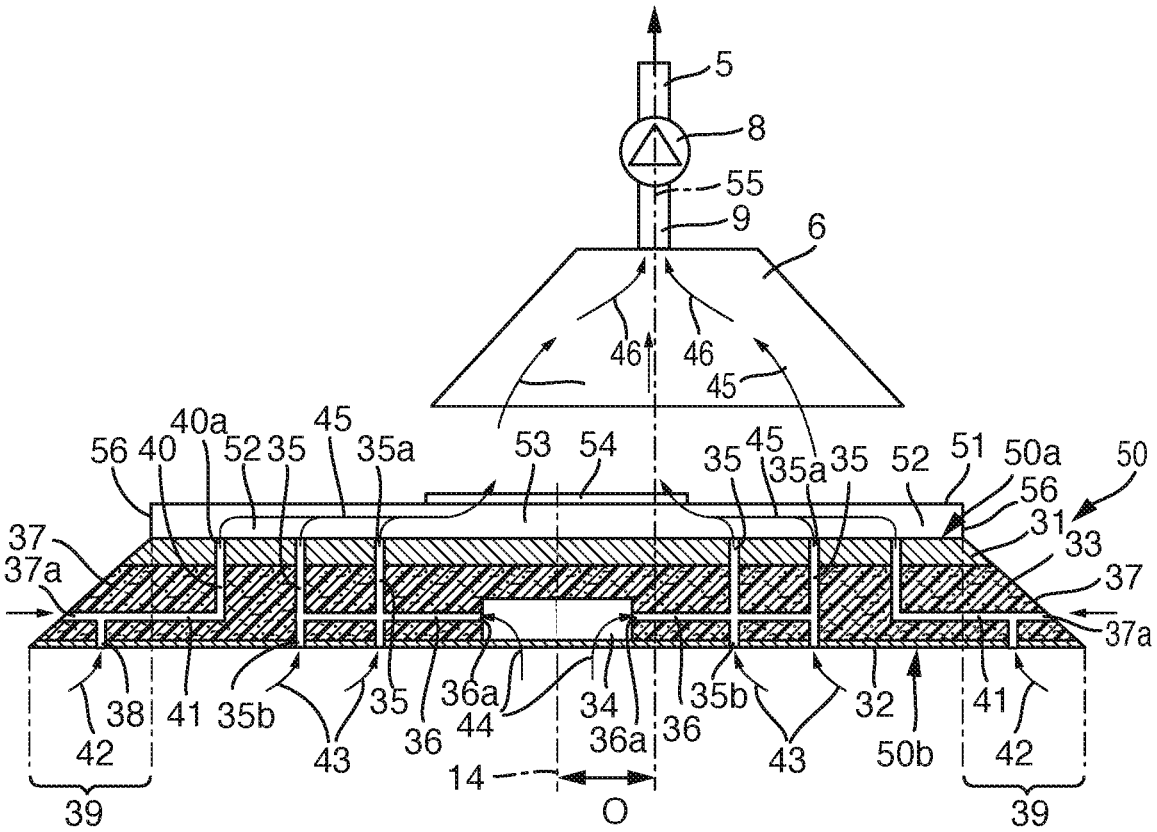
FIG. 10 is a schematic sectional view of another embodiment of a backing pad according to the present invention together with an aspiration cap of a dust extraction system of a tool, to which the backing pad is connected.

Although the embodiment of FIG. 9 is drawn as if the backing pad 30 performed a rotational actuating movement around rotational axis 14 only (rotational axis 14 of backing pad 30 identical to rotational axis of tool shaft), it would also be possible to provide for an appropriate mounting of the backing pad 30 so it can perform an orbital, a roto-orbital or a random orbital actuating movement as suggested in FIG. 10 (rotational axis 14 of backing pad 50 spaced apart from rotational axis 55 of tool shaft).

According to the present invention the backing pad 30 is provided with at least one additional hole 38, each of which located such that it ends in a bottom opening 38*b* located in an annular outer section 39 of the bottom surface 30*b*. The annular outer section 39 is located opposite to the slanting peripheral surface 37 of the backing pad 30. The at least one additional hole 38 is in connection with at least one opening 40*a* located in the top surface 30*a* of the backing pad 30. In particular, the top opening 40*a* is located in the top surface 30*a* such that during an orbital actuating movement of the backing pad 30 in respect to the static cap 6 of the dust extraction system of the tool 1 (see FIG. 10), the opening 40*a* is always covered by the static cap 6. In the sectional view of FIG. 9 two additional holes 38 are shown. Of course, the backing pad 30 can be provided with a plurality of additional holes 38 located in the annular outer section 39 and circumferentially spaced apart from one another.

The at least one additional hole 38 ending in the bottom opening 38*b* in the annular outer section 39 has a longitudinal extension essentially perpendicular to the top and bottom surfaces 30*a*, 30*b* of the backing pad 30, or axial to the axis 14 of rotation. In the embodiment of FIG. 9 the additional holes 38 extend through the adhesive layer 32 and part of the interface layer 33. The at least one opening 40*a* located in the top surface 30*a* of the backing pad 30 and in connection with the at least one additional hole 38 opens into at least one further additional hole 40 having a longitudinal extension essentially perpendicular to the top and bottom surfaces 30*a*, 30*b* of the backing pad 30, or axial to the axis 14 of rotation. The further additional holes 40 extend through the carrier layer 31 and part of the interface layer 33. The additional holes 38 ending in the bottom openings 38*b* in the annular outer section 39 of the bottom surface 30*b* of the backing pad 30 and the further additional holes 40 ending in the top openings 40*a* located in the top surface 30*a* of the backing pad 30 and in connection with the additional holes 38 are interconnected with one another by additional channels 41. The additional channels 41 extend preferably essentially parallel to the top and bottom surfaces 30*a*, 30*b* of the backing pad 30 or essentially radially. The additional channels 41 are located in the interface layer 33. At least part of the additional channels 41 interconnecting the additional holes 38 and the further additional holes 40 proceed radially outwards and open into the slanting circumferential surface 37 of the backing pad 30. The additional channels 41 opening into openings 37*a* have no pneumatic connection to the central recess 34 of the backing pad 30.

At least one of the pluralities of channels 36 interconnecting some of the holes 35 are extended radially inwards and open into the central recess 34 of the backing pad 30. The respective openings are designated with reference sign 36*a*. In this manner at least some of the holes 35 interconnected by one of the channels 36 are in pneumatic connection with the central recess 34. None of the channels 36 interconnecting some of the holes 35 and opening into the central recess 34 opens into the slanting circumferential surface 37 of the backing pad 30.

This design of the backing pad 30 and in particular of the holes 35, additional holes 38 and further additional holes 40 as well as their interconnection with one another by channels 36 or 41 as well as their connection to the environment (through openings 37*a* in the slanting circumferential surface 37 by channels 41) and to the central recess 34 (through openings 36*a* of channel 36 opening into the central recess 34), provide for a specific air flow along the bottom surface 30*b* of the backing pad 30 and the working surface, which has the advantage of a particularly effective dust extraction. In this manner the contamination of the environmental air with dust and other small particles can be significantly reduced allowing the operator of the tool 1 to better see the working surface (without dust on it) and providing for a significant improvement of the operator's overall working and sanitary situation.

The specific air flow between the bottom surface 30*b* of the backing pad 30 according to the present invention and the working surface is described in more detail by means of arrows shown in FIG. 9. An important difference to known backing pads 4 is that environmental air is not conveyed to the working surface via the central recess 34 (15 in the known backing pad 4) but is rather freely aspirated from the outer circumference of the backing pad 30 (arrows 42). The air flow runs from the environment surrounding the circumference of the backing pad 30 through an annular circumferential gap between the bottom surface 30*b* of the backing pad 30 and the working surface radially inwards to the openings 38*b* of the additional holes 38 and further to the openings 35*b* of the holes 35 thereby gathering dust from the working surface (arrows 42 and 43). Some of the dust-laden air even reaches the central recess 34 of the backing pad 30 and enters the holes 36*a* located in a circumferential wall of the central recess 34 (arrows 44). The dust-laden air enters the opening 38*b*, 35*b* in the bottom surface 30*b* and the openings 36*a* in the central recess 34, passes through the holes 38, 35 and channels 42, 36 and exits the holes 40, 35 through openings 40*a*, 35*a* located in the top surface 30*a* of the backing pad 30 (arrows 45). The various dust-laden air streams 45 exiting the openings 40*a*, 35*a* are combined by the cap 6 of the dust extraction system of the tool 1 (arrows 46) and finally conveyed to the suction tube 5 and further to a dust collecting unit (dust filter or vacuum cleaner) connected to the suction tube 5.

The present invention has the advantage that the additional holes 38 located in the annular outer section 39 of the bottom surface 30*b* of the backing pad 30 actively aspirate dust-laden air and actively remove dust and small particles from the working surface opposite to the annular outer section 39. Furthermore, it is advantageous that the amount of air participating at the air flow 42 . . . 46 is not limited by the diameter, number and/or length of aspiration channels. Rather, the air participating at the air flow 42 . . . 46 can freely enter the region between the bottom surface 30*b* of the backing pad 30 and the working surface through a circumferential gap between the outer circumference of the backing pad 30 and the working surface. Another reason for the very efficient dust extraction is the fact that an air flow 44 is aspirated by the central recess 44 and the channels 36 opening into the recess 34. This can significantly reduce the amount of dust in the center of the backing pad 30.

FIG. 10 shows another embodiment of the present invention. In this embodiment the backing pad is designated with reference sign 50. In this embodiment the eccentric mounting of the backing pad 50 in respect to the tool shaft can be clearly seen. The rotational axis 14 of the backing pad 50 is spaced apart by orbit o from an axis 55 of rotation of the tool shaft (not shown). The backing pad 50 performs an orbital, a roto-orbital or a random orbital actuating movement with orbit o. Most parts of the backing pad 50 of FIG. 10, in particular the holes 35, 38, 40 and the channels 36, 41 are similar or identical to the embodiment of FIG. 9. Therefore, they have been given the same reference signs.

The backing pad 50 comprises a deflection disk 51 attached to the top surface 50*a* of the backing pad 50. The deflection disk 51 is preferably made of a rigid material, the same or similar to the material of the carrier layer 31 of the backing pad 50. The deflection disk 51 can be designed separately from the carrier element 31 or can form a single integral part with the carrier layer 31. In a view from above the deflection disk 51 has an essentially annular form with a central opening 53. The deflection disk 51 is located above and spaced to the top surface 50*a* of the backing pad. The deflection disk 51 delimits an intermediate chamber 52 between the top surface 50*a* of the backing pad 50 and a bottom surface of the deflection disk 51. The intermediate chamber 52 is closed radially outwards by circumferential edge 56 and opens radially inwards into the central opening 53. In the embodiment of FIG. 10 the opening 53 is surrounded by collar 54. The deflection disk 51 is fixed to the top surface 50*a* of the backing pad 50 along the lower rim of the circumferential edge 56, for example by gluing or welding or a snap-on connection. The edge 56 could also be part of the top surface 50*a* of the backing pad 50, in which case the defection disk would be fixed with its bottom surface to the upper rim of the circumferential edge 56.

The advantage of the deflection disk 51 is that the cap 6 of the tool 1 can have a smaller diameter than if there was no deflection disk 51 (see FIG. 9). The diameter of the cap 6 should be at least that large that during the orbital actuating movement of the backing pad 50 the opening 53 of the deflection disk 51 is always and entirely covered by the bottom opening of the cap 6. The use of a deflection disk 51 is particularly advantageous when the backing pad 50 performs large orbital actuating movements with an orbit o in the range of 15 mm to 21 mm. However, the use of the deflection disk 41 is also advantageous for smaller orbits o, such as 5 mm or 10 mm.

The deflection disk 51 could also be designed without the circumferential edge 56 (see embodiments of FIGS. 2 to 7) such that it is directly fixed to the top surface 50*a* of the backing pad 50 without leaving an intermediate chamber 52 between the top surface 50*a* and the bottom surface of the deflection disk 51. In that case the top surface 60*a* of the backing pad 60 could be provided with groves and recesses 62 leading to one or more central openings 71 of the deflection disk 70. The grooves and recesses 62 are hermetically sealed by the deflection disk 70 fully attached to the top surface 60*a* of the backing pad 60. In that embodiment there could be a plurality of intermediate chambers designed by the groves and recesses 62 in the top surface 60*a* instead of the single intermediate chamber 52 between the top surface 50*a* and the deflection disk 51 of the embodiment of FIG. 10.

FIG. 2 shows another embodiment of a backing pad 60 according to the present invention. The top surface 60*a* of the backing pad 60 is designed for receiving a deflection disk 70 (see FIG. 4), which is not shown in FIG. 2. A threaded rod for attaching the backing pad 60 to the tool shaft of the tool 1 is designated with reference sign 61. The threaded rod 61 is fixedly attached to the carrier layer 31. Instead of the threaded rod 61, the backing pad 60 could also be provided with a recess adapted for receiving a distal end of the tool shaft having an outer contour corresponding to an internal contour of the recess. Of course, although not explicitly shown the backing pads 30, 50 are provided with similar or the same attachment mechanism for connection to the tool shaft.

The top surface 60*a* of the backing pad 60 is provided with a number of groves or recesses 62, which interconnect various holes 35. When the deflection disk 70 is attached to the top surface 60*a* of the backing pad 60 the groves or recesses 62 are hermetically sealed thereby forming internal chambers for conveying dust-laden air from holes 35, 40 located towards the outer circumference of the backing pad 60 essentially radially inwards towards holes 35'. With the deflection disk 70 attached to the backing pad 60, openings 71 in the deflection disk 70 are in alignment with the holes 35'. The dust-laden air exits the internal chambers through the openings 71. When the backing pad 60 performs its orbiting actuating movement the openings 71 in the deflection disk 70 are preferably always and entirely covered by the bottom opening of the cap 6 (not shown) of the dust extraction system of the tool 1.

As clearly shown in FIG. 2 by the example of holes 35", the holes do not necessarily have to pass through the entire height of the backing pad 60. Rather, holes 35" merely extend through the carrier layer 31 and possibly part of the interface layer 33.

In FIG. 2 the plurality of holes 35 located radially inwards from the annular outer section 39 of the bottom surface 60*b* of the backing pad 60 are shown. Furthermore, some of the additional holes 38 located in the annular outer section 39 are also shown. Further, additional channels 41 opening into opening 37*a* in the slanting peripheral surface 37 and interconnecting the additional holes 38 with the environment can be seen, too. A plurality of openings 37*a* is allocated on the slanting peripheral surface 37 of the backing pad 60 circumferentially spaced apart from one another.

Figure 3:
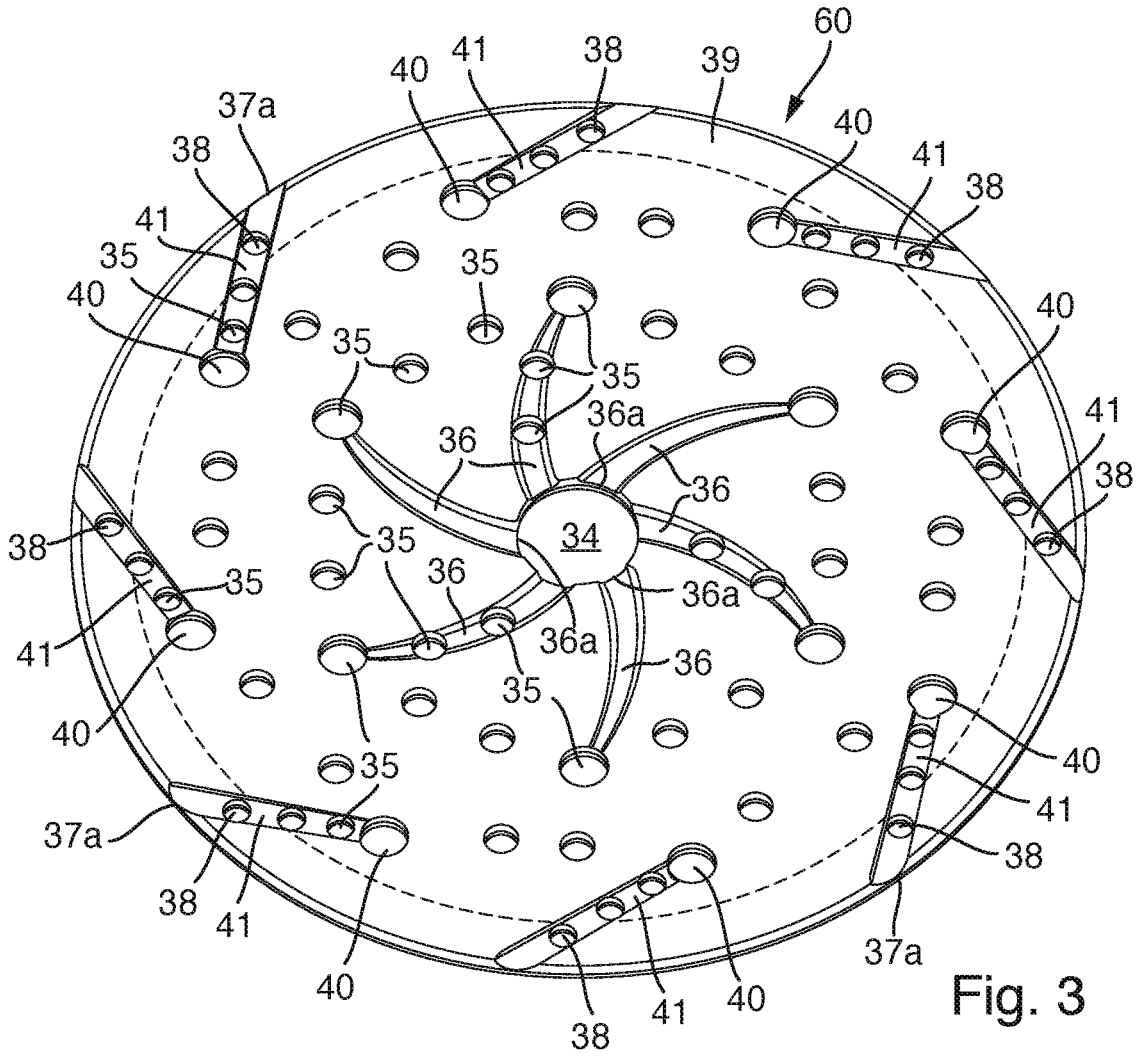
FIG. 3 is a perspective view from below of the backing pad illustrated in FIG. 2 in a perspective view from below.

FIG. 3 shows a longitudinal cross section through the backing pad 60 of FIG. 2. The annular outer section 39 of the backing pad 60 is indicated by a dashed line. FIG. 3 clearly shows the central recess 34 of the backing pad 60. Furthermore, the holes 35 and the channels 36 located radially inwards from the annular outer section 39 are clearly visible. Further, the additional holes 38 located in the annular outer section 39 can be seen. The additional channels 41 interconnecting the additional holes 38 with the openings 40*a* of the further additional holes 40 are also shown. Some of the additional holes 38 are located only partly in the annular outer section 39. Nonetheless they are still considered additional holes 38 in the sense of the present invention as long as they do not open directly into top openings 40*a* but rather by further channels 41 extending essentially radially.

It can be clearly seen that the channels 36 extend in an "essentially radial" direction from holes 35 towards the center recess 34. The channels 36 have an arcuated form along their longitudinal extension. The diameter of the channels 36 increases along their longitudinal extension from the holes 35 located at an external end of the channel 36 towards the opening 36*a* in the circumferential wall of the central recess 34. However, any other form or longitudinal extension of the channels 36 would be possible, too. The extension of the additional channels 41 is considered to be "essentially radially" in the sense of the present invention, too, because the inlet openings 37*a* are located further radially outwards than the outlets opening into the further additional holes 40. The channels 41 have an essentially straight extension. The diameter of the channels 41 decreases from the inlet openings 37*a* towards the outlets opening into the further additional holes 40. Of course, any other form or longitudinal extension of the further channels 41 would be possible, too. The further channels 41 connect the additional holes 38 with the further additional holes 40, which open into the grooves and recesses 62 (sealed by the deflection disk 70) leading to the inner holes 35' in the top surface 60*a* of the backing pad 60 and finally to the openings 71 opposite to the cap 6. The additional channels 41 can also interconnect conventional holes 35 with the further additional holes 40 as shown in FIG. 3.

Figure 5:
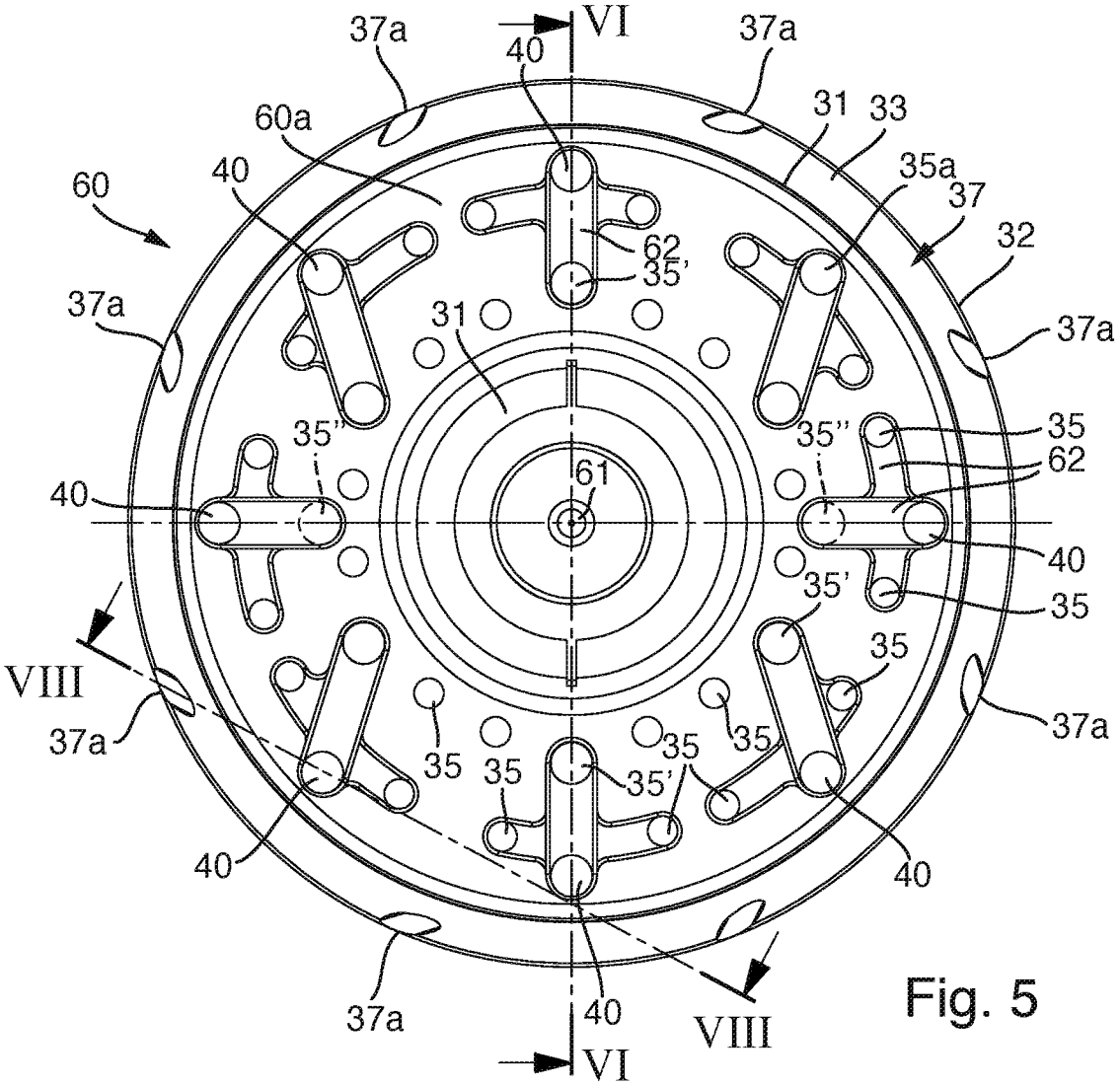
FIG. 5 is a top view of a backing pad for a hand-guided polishing or sanding power tool according to the present invention without a deflection disk.

FIG. 4 shows a perspective view of the backing pad 60 with a partial cross section along line VIII-VIII of FIG. 5. The holes 35, additional holes 38 and further additional holes 40 as well as the channels 36 and the additional channels 41 can be clearly seen in FIG. 4. Furthermore, in FIG. 4 the deflection disk 70 is attached to the top surface 60*a* of the backing pad 60 thereby hermetically sealing the groves or recesses 62 except for the openings into the holes 35' (see FIG. 2) leading to the openings 71 in the deflection disk 70.

Figure 6:
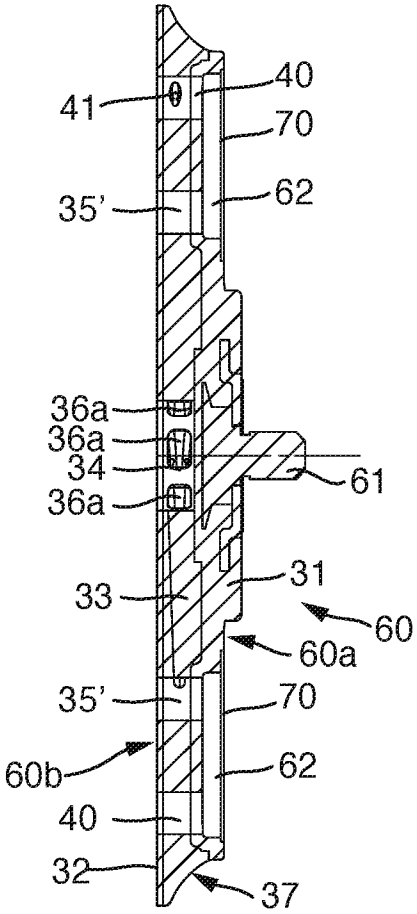
FIG. 6 is a sectional view taken along line VI-VI of the backing pad of FIG. 5.
Figure 7:
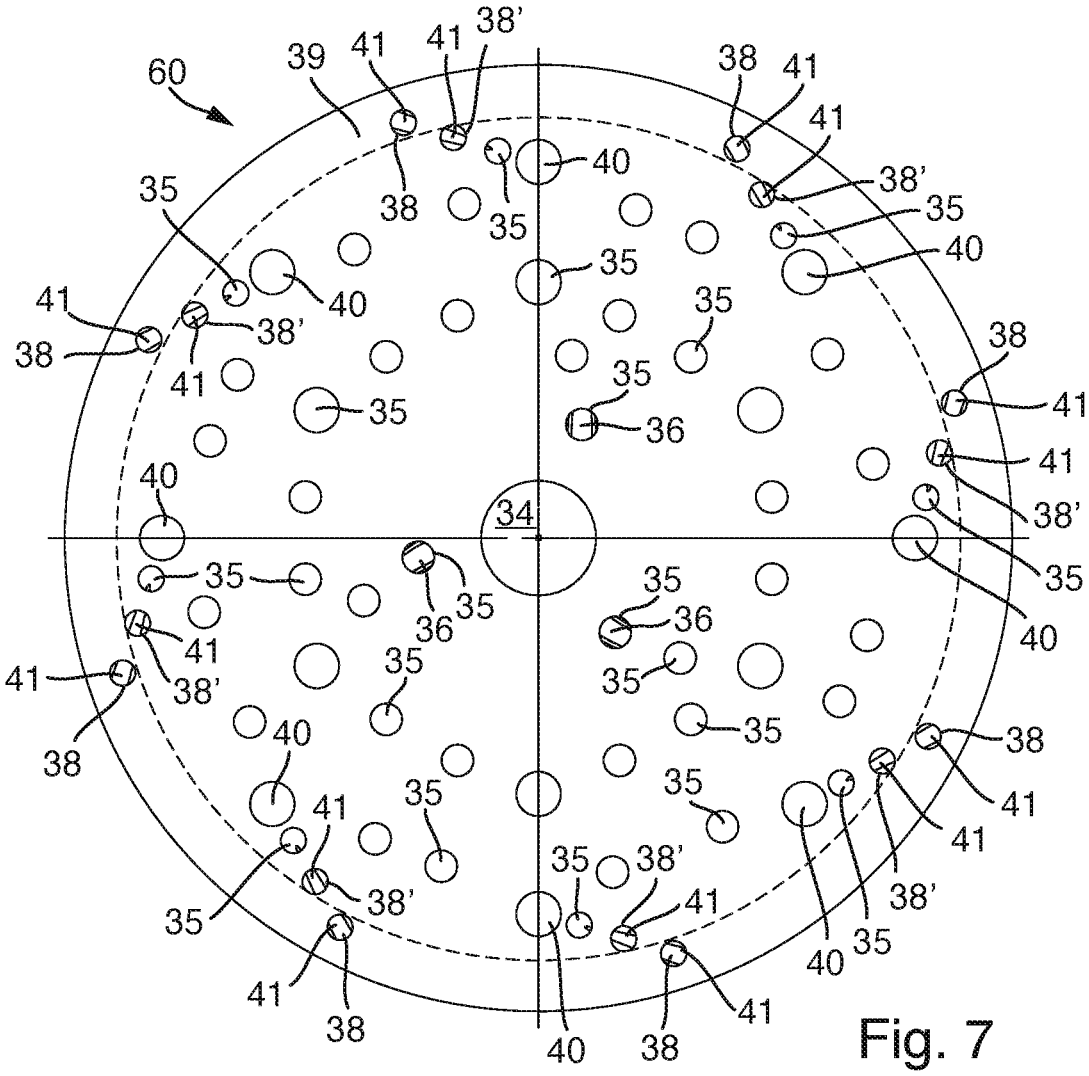
FIG. 7 is a bottom view of the backing pad illustrated in FIG. 5.
Figure 8:
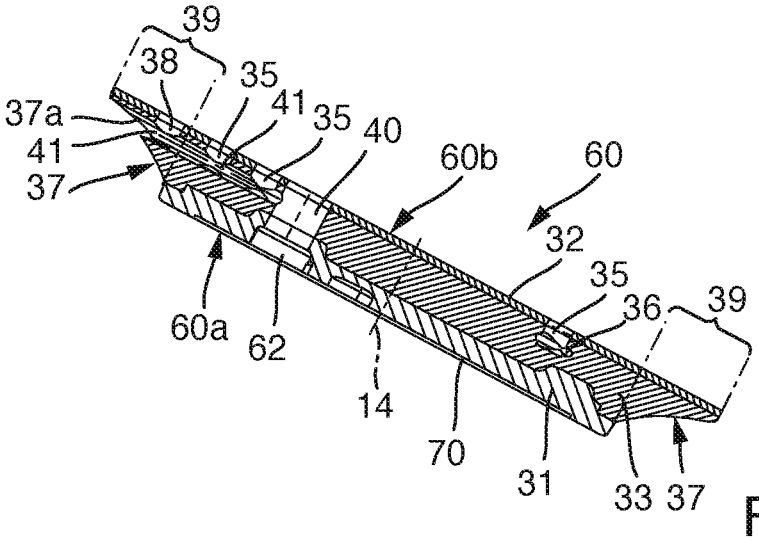
FIG. 8 is a section view along the line VIII-VIII of the backing pad illustrated in FIG. 5.

FIG. 5 shows a top view of the backing pad 60 of FIG. 2 without the deflection disk 70. FIG. 6 shows a sectional view of the backing pad 60 of FIG. 5 along line VI-VI with the deflection disk 70 attached to the top surface 60*a* of the backing pad 60. FIG. 7 shows a bottom view of the backing pad 60 of FIG. 5. Again, the annular outer section 39 is shown by dashed line. It can be clearly seen that the additional holes 38 are located within the annular outer section 39 and that conventional holes 35 are located outside, that is radially inwards from the annular outer section 39. Some additional holes 38' are located only partly in the annular outer section 39. Nonetheless, they still open into the further additional holes 40 only by the additional channels 41. FIG. 8 is another sectional view of the backing pad 60 of FIG. 5 along the line VIII-VIII. An additional hole 38 and a further additional hole 40 as well as the interconnecting channel 41 can be clearly seen. Furthermore, it can be seen that the interconnecting channel 41 opens into opening 37*a* in the outer circumferential surface 37 of the backing pad 60.

The invention has been described in an illustrative manner. It is to be understood that the terminology which has been used is intended to be in the nature of words of description rather than of limitation. Many modifications and variations of the invention are possible in light of the above teachings. Therefore, within the scope of the appended claims, the invention may be practiced other than as specifically described.

The invention claimed is:

1. A backing pad for a hand guided polishing or sanding tool, the backing pad having an essentially plate-like form and a trapezoid cross-section with a top surface, a bottom surface and a slanting circumferential surface resulting in the bottom surface that is larger than the top surface by an annular outer section forming part of the bottom surface, the annular outer section being located opposite to the slanting circumferential surface of the backing pad, the backing pad adapted to be fixedly connected to a moving mounting part of the tool at the top surface and to receive a polishing or sanding material on the bottom surface, the backing pad including a plurality of channels each extending essentially radially and essentially parallel to the top and bottom surfaces through at least part of the backing pad, a central recess located in the bottom surface and a plurality of through holes each having a longitudinal extension essentially perpendicular to the top and bottom surfaces through the backing pad and connecting an opening in the bottom surface with an opening in the top surface, the backing pad further includes at least one additional hole each located such that it ends in an opening located in the bottom surface of the annular outer section and that the at least one additional hole is in connection with at least one opening located in the top surface of the backing pad.

2. The backing pad as set forth in claim 1, wherein the at least one additional hole ending in the opening in the annular outer section of the bottom surface of the backing pad has a longitudinal extension essentially perpendicular to the top and bottom surfaces of the backing pad.

3. The backing pad as set forth in claim 1, wherein the at least one opening located in the top surface of the backing pad and in connection with the at least one additional hole opens into at least one further additional hole having a longitudinal extension essentially perpendicular to the top and bottom surfaces of the backing pad.

4. The backing pad as set forth in claim 3, wherein the at least one additional hole ending in the opening in the annular outer section of the bottom surface of the backing pad and the at least one further additional hole ending in the at least one opening located in the top surface of the backing pad and in connection with the at least one additional hole are interconnected with one another by at least one additional channel extending essentially parallel to the top and bottom surfaces of the backing pad.

5. The backing pad as set forth in claim 4, wherein the at least one additional channel interconnecting the at least one additional hole and the at least one further additional hole proceeds radially outwards and has an opening into the slanting circumferential surface of the backing pad.

6. The backing pad as set forth in claim 1, wherein at least one of the plurality of channels each extending essentially parallel to the top and bottom surfaces interconnects the central recess with at least one of the plurality of holes each having a longitudinal extension essentially perpendicular to the top and bottom surfaces and connecting an opening in the bottom surface with an opening in the top surface of the backing pad.

7. The backing pad as set forth in claim 6, wherein none of the plurality of channels each extending essentially parallel to the top and bottom surfaces opens into the slanting circumferential surface of the backing pad.

8. The backing pad as set forth in claim 1, wherein the backing pad includes a carrier layer made of a rigid material and forming the top surface of the backing pad, an adhesive layer forming the bottom surface of the backing pad and adapted for releasably connecting the polishing or sanding material thereto and an interface layer made of a resilient material and located between the carrier layer and the adhesive layer, wherein the plurality of channels and the at least one additional channel each extending essentially radially and essentially parallel to the top and bottom surfaces of the backing pad are arranged in the interface layer.

9. The backing pad as set forth in claim 8, wherein the backing pad is manufactured by molding all three layers and attaching them to one another by a single molding process.

10. The backing pad as set forth in claim 8, wherein the plurality of channels and the at least one additional channel each extending essentially radially and essentially parallel to the top and bottom surfaces are arranged in the interface layer during a molding process.

11. The backing pad as set forth in claim 8, wherein the carrier layer includes a threaded rod or a receiving opening for fixedly connecting the backing pad to the moving mounting part of the tool.

12. The backing pad as set forth in claim 1, wherein the backing pad includes a deflection disk attached to the top surface of the backing pad, wherein the deflection disk has an essentially annular form and delimits at least one internal chamber between the top surface of the backing pad and a bottom side of the deflection disk, the at least one internal chamber being closed radially outwards and having at least one opening facing radially inwards.

13. The backing pad as set forth in claim 12, wherein the deflection disk is located above and spaced apart from the top surface of the backing pad and delimits said internal chamber.

14. The backing pad as set forth in claim 12, wherein grooves or recesses are provided in the top surface of the backing pad and a full face of the bottom side of the deflection disk is attached to the top surface, thereby hermetically sealing the grooves and recesses except for the at least one opening facing radially inwards, and wherein the sealed grooves or recesses form a plurality of internal chambers.

15. An electrically or pneumatically actuated hand guided polishing or sanding tool comprising a backing pad with a polishing or sanding material attached to a bottom surface of the backing pad, wherein the polishing or sanding material attached to the bottom surface performs a rotary, an orbital, a roto-orbital or a random orbital actuating movement if the tool is actuated, the backing pad has an essentially plate-like form and a trapezoid cross-section with a top surface, a bottom surface and a slanting circumferential surface resulting in the bottom surface that is larger than the top surface by an annular outer section forming part of the bottom surface, the annular outer section being located opposite to the slanting circumferential surface of the backing pad, the backing pad adapted to be fixedly connected to a moving mounting part of the tool at the top surface and to receive a polishing or sanding material on the bottom surface, the backing pad includes a plurality of channels each extending essentially radially and essentially parallel to the top and bottom surfaces through at least part of the backing pad, a central recess located in the bottom surface and a plurality of through holes each having a longitudinal extension essentially perpendicular to the top and bottom surfaces through the backing pad and connecting an opening in the bottom surface with an opening in the top surface, the backing pad further includes at least one additional hole each located such that it ends in an opening located in the bottom surface of the annular outer section and that the at least one additional hole is in connection with at least one opening located in the top surface of the backing pad.

* * * * *